US007695771B2

(12) United States Patent
Ostrovsky

(10) Patent No.: US 7,695,771 B2
(45) Date of Patent: Apr. 13, 2010

(54) PROCESS FOR FORMING A WELL VISIBLE NON-CHROMATE CONVERSION COATING FOR MAGNESIUM AND MAGNESIUM ALLOYS

(75) Inventor: Ilya Ostrovsky, Alonim (IL)

(73) Assignees: Chemetall GmbH, Frankfurt (DE); Alonim Holding Agricultural Cooperative Society Ltd., Kibbutz, Alonim (IL)

( * ) Notice: Subject to any disclaimer, the term of this patent is extended or adjusted under 35 U.S.C. 154(b) by 1027 days.

(21) Appl. No.: 11/106,028

(22) Filed: Apr. 14, 2005

(65) Prior Publication Data

US 2006/0234072 A1 Oct. 19, 2006

(51) Int. Cl.
*B05D 1/18* (2006.01)

(52) U.S. Cl. ..... 427/435; 427/299; 427/327; 427/436

(58) Field of Classification Search ..... 427/327, 427/328; 106/14.05, 14.11
See application file for complete search history.

(56) References Cited

U.S. PATENT DOCUMENTS 2,313,754 A 3/1943 Loose
2002/0096230 A1 * 7/2002 Hardin et al. ..... 148/243
2003/0000847 A1 * 1/2003 Ostrovsky ..... 205/321
2003/0205299 A1 * 11/2003 Greene et al. ..... 148/273

FOREIGN PATENT DOCUMENTS

| | | | |
|---|---|---|---|
| EP | 1 405 933 | A1 | 4/2004 |
| GB | 1 507 816 | | 4/1978 |
| WO | WO 99/60186 | A1 | 11/1999 |
| WO | WO 00/24948 | A1 | 5/2000 |
| WO | WO 03/002773 | A2 * | 1/2003 |

* cited by examiner

*Primary Examiner*—David Turocy
(74) *Attorney, Agent, or Firm*—Fulbright & Jaworski L.L.P.

(57) ABSTRACT

The present invention is directed to a process for forming a well visible non-chromate conversion coating on surfaces of magnesium and magnesium alloys, to a composition therefor and to a method of use for such coated articles having surfaces of magnesium or any magnesium alloy. The composition is a solution or dispersion comprising a fluorosilicon acid. The composition is preferably an aqueous solution having a pH in the range from 0.5 to 5 and includes often at least one pH adjustment agent. The thereof formed coating is useful to increase the corrosion resistance and the adhesion of magnesium and magnesium alloys to a paint coating, powder coating, e-coat, fluoropolymer coating, self-lubricant layer and adhesive bonding layer. The conversion coating may favorably be coated with a fluoropolymer coating, coated with a silane based sealing or both. The such formed coating is typically of grey mat non-metallic appearance.

80 Claims, 1 Drawing Sheet

PROCESS FOR FORMING A WELL VISIBLE NON-CHROMATE CONVERSION COATING FOR MAGNESIUM AND MAGNESIUM ALLOYS

FIELD OF THE INVENTION

The present invention is directed to a process for forming a well visible non-chromate conversion coating on surfaces of magnesium and magnesium alloys, to a composition therefor and to a method of use for such coated articles having surfaces of magnesium or of any magnesium alloy. It is more generally directed to the field of metal surface protection and particularly to surface treatments that increase corrosion resistance and paint adhesion of surfaces of magnesium and magnesium alloys.

BACKGROUND OF THE INVENTION

Magnesium and magnesium alloys are specifically useful for the manufacturing of many light weight components and of many critical components for severe applications, for example for the manufacturing of secondary structural elements for aircrafts as well as of components for vehicles and electronic devices, because of their light weight and strength.

One of the significant disadvantages of magnesium and magnesium alloys is their sensitivity for corrosion. Exposure to hazardous chemical conditions causes magnesium rich surfaces to corrode quickly. Corrosion is unaesthetic and reduces strength.

A method that is often used to improve the corrosion resistance of metallic surfaces is painting. When the metallic surface is protected by a thick paint layer from the contact with corrosive agents, corrosion is prevented. However, many types of paint do not bind well to magnesium and magnesium alloy surfaces.

Methods based on chemical conversion of an outer metallic surface using chromate solutions are well known in the art as being useful for treating magnesium and magnesium alloy surfaces to increase corrosion resistance and paint adhesion, see for example U.S. Pat. Nos. 2,035,380 or 3,457,124. Chromate containing coatings are mostly colored and excellent visible. However, the corrosion resistance of treated magnesium rich surfaces is typically very low—quite different from other metallic substrates coated with a chromate coating—and the environmental unfriendliness as well as the dangers for living beings of chromate solutions are definite disadvantages of these methods.

Several methods of metal surface treatment using non-chromate conversion coatings have been disclosed, for example in U.S. Pat. Nos. 5,292,549, 5,750,197, 5,759,629 and 6,106,901. Silane solutions are environmentally friendly and lend excellent corrosion resistance to treated metal surfaces. Silane from the solution binds to a treated metallic surface forming a layer to which commonly used polymers such as paint or adhesive may be further applied, see U.S. Pat. No. 5,750,197.

U.S. Pat. No. 6,777,094 teaches to provide a silane pretreatment on magnesium and magnesium alloys. Although the disclosed treatment offers excellent paint adhesion and corrosion protection, the coating is transparent and requires special on-line control methods.

Many of the present non-chromate treatment technologies are based on Group IV metals of the Periodical Table of Chemical Elements such as titanium, zirconium or hafnium, a source of fluoride ion and a mineral acid for a pH adjustment. For example, U.S. Pat. No. 3,964,936 discloses the use of zirconium, fluoride, nitric acid and boron to produce a uniform, colorless and clear conversion coating for aluminum. U.S. Pat. No. 4,148,670 teaches a clear conversion coating comprising zirconium, fluoride and phosphate. U.S. Pat. No. 4,273,592 concerns a coating comprising zirconium, fluoride and a $C_{1-7}$ polyhydroxy compound, wherein the composition is essentially free of phosphate and boron. U.S. Pat. No. 6,083,309 refers to a coating comprising Group IV metals such as zirconium in combination with one or more non-fluoro anions while fluorides are specifically excluded from the processes and compositions above certain levels. The main lack of these conversion coatings is again the lack of a color and visibility, as the coatings are all clear and colorless or mostly colorless.

Recently disclosed well visible non-chromate conversion coatings include additionally to the metals of Group IV of the Periodic Table of Chemical Elements and to fluorides also any a special color providing component, such as an alizarine dye in U.S. Pat. No. 6,464,800 and such as permanganic acid and its water soluble salts in U.S. Pat. No. 6,485,580.

Permanganic acid is not preferred as its coloring effect is too strong and as its impurities are difficult to avoid and to remove. But the main lack of compositions containing permanganic acid or any of its salts is a low stability in contact with a magnesium rich surface so that it requires an addition of at least one sequestering agent and an extended use of chemicals.

The addition of organic dyes to process solutions usually leads to higher coating costs, to complicate compositions and to difficulties to control the process solution by optical methods like photometry.

Additionally, one critical disadvantage of non-chromate conversion coatings based on Group IV metals of the Periodic Table of Chemical Elements is the very low adhesion of the formed conversion coating to fluoropolymer coatings. Anodizing coatings or phosphate coatings are usually used as pretreatment coatings for magnesium rich surfaces, often prior to a PTFE coating.

Anodizing coatings or phosphate coatings are also used like pretreatment coatings prior to applying self-lubricant coatings like $MoS_2$ or graphite containing coatings on metal sliding components and in forming technologies like deep-drawing or forging.

Anodizing coatings as well as most of the phosphate coatings are well visible on magnesium rich surfaces. However, as it is well known for one skilled in the art, thick crystalline phosphate conversion coatings often fail to form layers on magnesium surfaces showing sufficient corrosion resistance and paint adhesion. Providing an anodizing technology for magnesium rich surfaces requires a complicate and expensive equipment.

It would be highly advantageous to have a method for treating magnesium and magnesium alloys with a non-complicate and stable composition which allows to form a well visible coating layer which has at least the same corrosion resistance and at least the same adhesion of the conversion coating to paint coatings, powder coatings, e-coats, fluoropolymer containing coatings, self-lubricant layers like coatings containing $MoS_2$ or graphite like conversion coatings and adhesives layers typically used in the art for magnesium rich surfaces.

It has now been found that aqueous compositions containing a fluorosilicon acid and optionally a pH adjustment agent form either invisible clear and mostly even colorless coatings or no coatings on surfaces on aluminum, aluminum alloys, steel and zinc, but the same compositions or modified compositions form well visible grey or black crack-free coatings with a mat non-metallic appearance on surfaces of magnesium or magnesium alloys.

SUMMARY OF THE INVENTION

Figure 1:
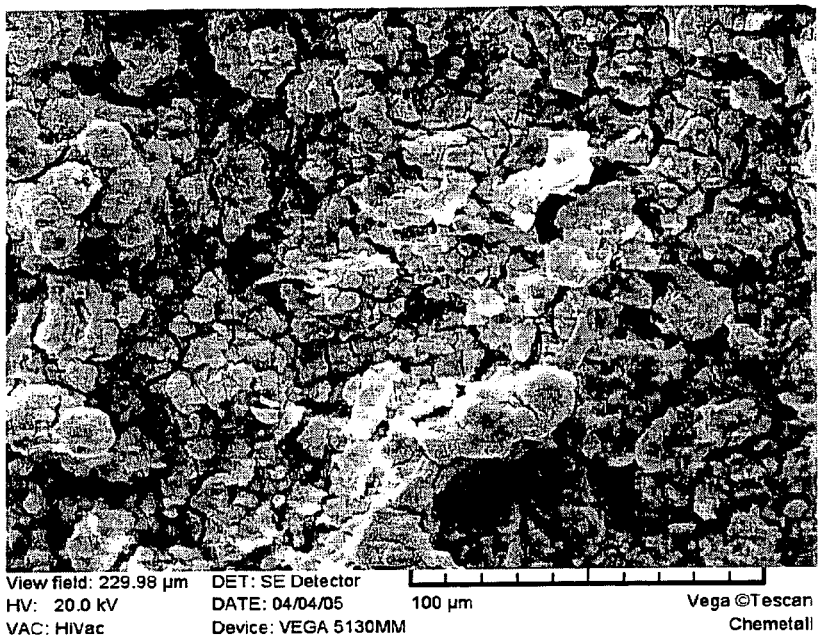
FIG. 1 is a photograph taken by a scanning electron microscope of a coating formed by a process solution applied to the surface of AZ31 magnesium alloy.

The present invention concerns a process for forming a well visible non-chromate conversion coating on surfaces of magnesium or magnesium alloys comprising the steps of:

a) providing clean surfaces of magnesium or magnesium alloys, b) contacting said surfaces with a process solution, c) whereby said process solution is an aqueous solution or an aqueous dispersion heaving a pH in the range from 0.5 to 5 and comprising:

i. at least one fluorosilicon acid, ii. optionally, at least one water-soluble pH adjustment agent, iii. optionally, at least one surfactant and iv. optionally, aluminum as cations or as at least one compound or any combination of these, d) whereby a well visible coating is formed with the aid of the process solution and whereby optionally in a step e) or in the steps e), f) and optionally any further step(s) at least one further coating each may be applied.

Further on, there may be even applied any further coating (s) g), h) or even i) or any combination of these if wanted, especially if there is applied a paint system of 2 to 5 paint layers, mostly of 3 or 4 paint layers.

The present invention concerns further on a well visible non-chromate conversion coating produced by a process according to the invention.

The present invention concerns finally a method of use of an article having at least on a part of its metallic surface a surface of magnesium or of any magnesium alloy which is coated with at least one coating according to the invention for aircrafts, aerospace, missiles, vehicles, trains, electronic devices, apparatuses, construction, military equipment or sport equipment. Such process is excellent for covering especially the internal metallic surfaces of tubes and frames like bicycle frames whereby it is easy to protect the external metallic surfaces by a paint system. A thick coating according to the invention is much easier to apply than by an anodizing process.

The at least one pH adjustment agent is more preferred at least one substance selected from the group consisting of metal hydroxides, ammonium hydroxide and alkaline silanes/silanols/siloxanes/polysiloxanes. The composition may optionally include an aluminum source like aluminum fluoride or at least one surfactant having at least one chain of medium or long length or any combination thereof.

According to the teachings of the present invention there is provided a composition useful for increasing the corrosion resistance and the adhesion of magnesium and magnesium alloys to a paint coating, a powder coating, an e-coat with an electroconductive paint layer (=electrocoating), a fluoropolymer coating, a self-lubricant containing layer and an adhesive bonding layer.

DETAILED DESCRIPTION OF THE INVENTION

The surfaces to be coated are at least partially surfaces of magnesium, of any magnesium alloy or of any combination thereof. It is preferred that these magnesium rich surfaces are not anodized as such surfaces do typically not release sufficient magnesium cations in an etchant.

According to the teachings of the present invention there is provided an aqueous composition, especially an aqueous solution, useful for the non-chromate conversion coating of magnesium and magnesium alloys with this composition. The composition provides the formation of a well visible coating. The aqueous composition may be a solution or dispersion, but often being a solution. The aqueous composition comprises a fluorosilicon acid like tetrafluorosilicon acid or hexafluorosilicon acid or both and has a pH in the range from 0.5 to 5. It often includes at least one pH adjustment agent. Preferably, the acid added to or contained in the process solution is or is predominantly a hexafluorosilicon acid. But alternatively, the process solution may contain a minor or seldom a major content of tetrafluorosilicon acid, too, or only this compound as mentioned under i. A content of any fluorosilicon acid is a necessary ingredient for the process solution according to the invention, preferably added as an acid and not or only in a minor content as a salt like ammonium silicon fluoride, sodium silicon fluoride, potassium silicon fluoride, magnesium silicon fluoride or any combination of these, as these salts may easily raise the pH to relative high values.

The concentration of the at least one fluorosilicon acid in the process solution is preferably in the range from 1 to 100 g/l, more preferred in the range from 2 to 84 g/l or from 4 to 72 g/l, most preferred in the range from 6 to 62 g/l or from 10 to 51 g/l, often in the range from 15 to 45 g/l or from 18 to 40 g/l, especially at least 1.2 g/L, at least 2 g/L, at least 3 g/L, at least 5 g/L, at least 8 g/L, at least 12 g/L, at least 16 g/L, at least or up to 20 g/L, at least or up to 25 g/L, up to 30 g/L, up to 40 g/L, up to 50 g/L, up to 60 g/L, up to 70 g/L, up to 80 g/L, up to 85 g/L, up to 90 g/L or up to 95 g/L or any combination thereof.

Nevertheless, there may be further on a content of any fluoro acid of boron, aluminum, titanium, hafnium, zirconium or any combination of these. It has been found that such a content if it is a significantly smaller amount than the amount of the fluorosilicon acid does mostly not influence the stability of the process solution and does often not significantly influence the properties of the thereof formed coating. The said aqueous solution is in many embodiments preferably essentially free of Group IV metals. The Group IV metals of the Periodical Table of Chemical Elements like titanium, hafnium and zirconium may be present for example as any complex fluoride. They may be generated in the process solution by the reaction of the process solution with alloying elements of the magnesium alloy surfaces or they may be added to the process solution preferably only in a small amount or both.

It is not necessary to add any pH adjustment agent to the process solution as it is possible to generate a well visible coating with it. In many embodiments, there may be added to or contained in the process solution an amount of cations or of at least one compound selected from the group consisting of boron, titanium, hafnium and zirconium. In other embodiments, there may be essentially no or no content of such cations and compounds. Preferably, the said aqueous solution is essentially free or free of cations and compounds of Group IV metals of the Periodical Table of Chemical Elements.

According to a feature of the present invention, the said pH adjustment agent is added in an amount needed to adjust the solution in the pH range from 0.5 to 5, more preferable in the range from 0.8 to 4 and even more preferable in the range from 1 to 3, much more preferred to a value in the range from 1.2 to 2.8, most preferred to a value in the range from 1.5 to 2.5. Preferably, the pH of the process solution is in the range from 0.8 to 4, even more preferred it is in the range from 1 to 3. Most preferred, the pH of the process solution is adjusted to a pH in the range from 1 to 2 or to 1.5 to 2.5. At a pH significantly above 4 it may sometimes happen that there does not develop a thick coating or does develop only an inhomogeneous coating or only a non-closed coating showing some isles of the coating or even that there does not form any well visible coating. The pH may be measured with a standard pH electrode, although this electrode may be not very accurate in these low pH ranges or a high fluoride content in the tested solution or both.

According to a feature of the present invention, at least one pH adjustment agent is added. The pH adjustment agent may preferably be selected from the group consisting of $NH_4OH$, LiOH, NaOH, KOH, $Ca(OH)_2$, at least one compound on the base of any amine, at least one compound on the base of any imine, at least one compound on the base of any amide, at least one compound on the base of any imide and at least one alkaline silane/silanol/siloxane/polysiloxane. Without any addition of a pH adjustment agent, the process solution will often show a pH of about 0.8 to about 1.2, but the pH adjustment agent shall help to increase the pH to values preferably in the range from 1.3 to 3, often to a pH in the range from 1.5 to 2.5.

For many embodiments of the present invention, there is no need to add any acidic pH adjustment agent with a strong acidic effect to the process solution so as to lower the pH. For several embodiments, there is no need to add any non-alkaline pH adjustment agent to the process solution, but it is often preferred to add a certain amount of an alkaline pH adjustment agent. The pH adjustment agent may more preferred comprise a content of $NH_4OH$, NaOH, KOH, $Ca(OH)_2$, an alkaline silane/silanol/siloxane/polysiloxane or any mixture of them.

If the pH is too low, there is a high etching rate and a low coating rate, if the pH is too high, there is a low etching rate and a high coating rate. Therefore, often a medium pH is preferred. In many embodiments, it is preferred to have a coating rate that is higher than the etching rate.

In many embodiments, it is preferred to have either at least one compound from the first group mentioned here (hydroxides, amines etc.) or at least one compound from the second group mentioned here (silanes etc.), but often no combination with essential amounts of additions of both groups.

If there is added at least one compound selected from the group consisting of $NH_4OH$, LiOH, NaOH, KOH, $Ca(OH)_2$, on the base of any amine, any imine, any amide and any imide ("the first group"), the concentration of all such compounds may preferably be in the range from 0.05 to 50 g/l, more preferred in the range from 0.1 to 32 g/l or in the range from 0.15 to 20 g/l, most preferred in the range from 0.2 to 12 g/l, from 0.35 to 6.5 g/l or from 0.5 to 5.5 g/l, especially at least 0.6 g/l, at least 0.8 g/l, at least 1.0 g/L, at least 1.2 g/L, at least 1.4 g/L, at least 1.6 g/L, at least 1.8 g/L, at least 2 g/L, at least 2.2 or up to g/L, at least or up to 2.4 g/L, at least or up to 2.6 g/L, at least or up to 2.8 g/L, at least or up to 3 g/L, at least or up to 3.2 g/L, at least or up to 3.4 g/L, at least or up to 3.6 g/L, at least or up to 3.8 g/L, at least or up to 4 g/L, up to 4.5 g/L, at least or up to 5 g/L, up to 7 g/L, up to 9 g/L or up to 14 g/L or any combination thereof.

But if there is added at least one compound selected from the group of alkaline silanes/silanols/siloxanes/polysiloxanes ("the second group"), the concentration of all these compounds may preferably be in the range from 0.05 to 50 g/l, more preferred in the range from 0.2 to 45 g/l or in the range from 0.5 to 40 g/l, most preferred in the range from 0.8 to 35 g/l, in the range from 1 to 30 g/l or in the range from 1.2 to 25 g/l, often even in the range from 1.5 to 20 g/l, from 1.8 to 12 g/l or from 2 to 10 g/l, especially at least 0.6 g/l, at least 0.9 g/l, at least 1.3 g/L, at least 1.6 g/L, at least 2.1 g/L, at least or up to 2.5 g/L, at least or up to 3 g/L, at least or up to 3.5 g/L, at least or up to 4 g/L, at least or up to 4.5 g/L, at least or up to 5 g/L, at least or up to 6 g/L, at least or up to 7 g/L, at least or up to 8 g/L, at least or up to 9 g/L, up to 11 g/L, up to 13 g/L, up to 15 g/L, up to 18 g/L, up to 22 g/L, up to 24 g/L, up to 28 g/L or up to 32 g/L or any combination thereof.

If the process solution contains at least one compound selected from the group consisting of $NH_4OH$, LiOH, NaOH, KOH, $Ca(OH)_2$, on the base of any amine, of any imine, of any amide and of any imide, the process solution may be cheaper than by adding at least one compound from the second group, but the behavior of the process solution may mostly be the same as if only pH adjustment agents would be added selected from the second group.

Figure 2:
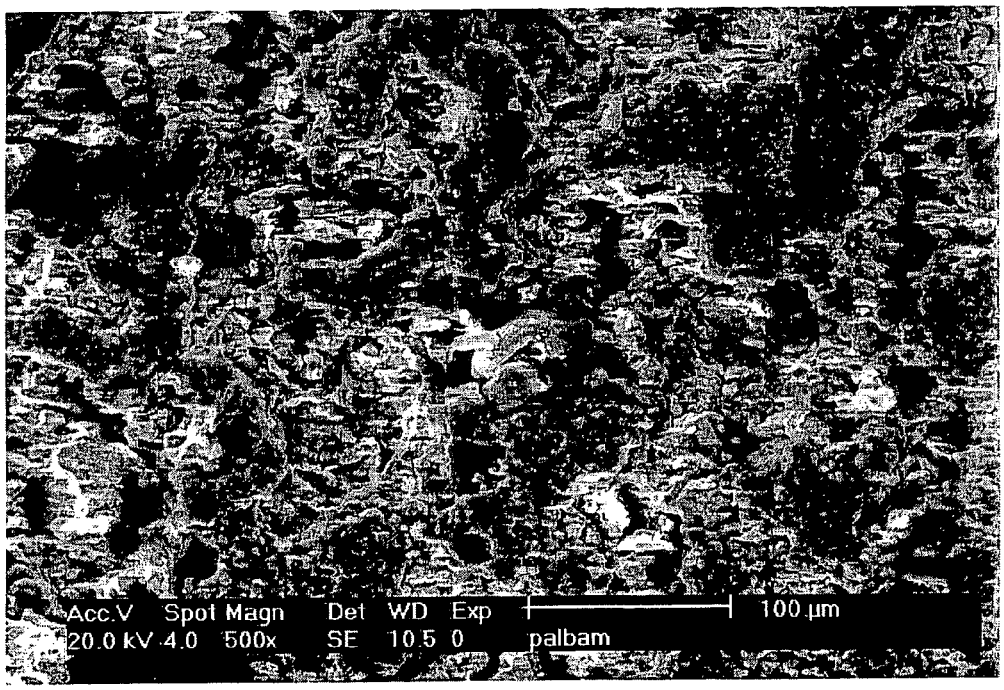
FIG. 2 is a photograph taken by a scanning electron microscope of a coating formed by a process solution applied to the surface of AZ91 magnesium alloy.

The coating formed with a process solution containing at least one pH adjustment agent from this first group may often show a lot of fine particles on the top of the coating generating a microroughness. The coating is often hydrophilic. There seem to be mostly irregularly formed particles and some rounded particles on top of the conversion coating to be seen on the surface of an AZ31 magnesium alloy surface coated with the process solution 2 according to Table 1 (see FIG. 1, photograph taken by a scanning electron microscope). This coating has a very high microroughness. In comparison thereto, FIG. 2 shows a silane sealing which is at least partially covering the conversion coating formed with the process solution 2 according to Table 1 on the surface of the magnesium alloy AZ91. This figure seems to show many particles of which singular particles seem to have a size of more than 20 μm, and it discloses a high microroughness of the surface. The bare corrosion of coatings formed from process solutions containing at least one pH adjustment agent from this first group is often sufficiently good, this means for example that for a salt-spray test according DIN 50021 and for a coating thickness of 15 to 20 μm the first corrosion pits occurred already after 7 hours of testing. After a testing time of 24 hours, only 60 to 80% of the surface area of the coated and tested surface was corroded. If then for this type of coating a silane sealing was formed above the conversion coating in a further process step with the silane containing product OXSILAN® MG 0611 of Chemetall GmbH, the panels showed after 24 hours of a salt-spray test for thin coatings of about 0.6 μm thickness applied with a diluted silane sealing solution a corroded surface to only 1 to 20% of the surface area, whereas such panels having a thick coating of about 1 μm thickness applied with a concentrated silane sealing showed a corroded surface even less than 1% of the surface area. These are excellent bare corrosion data for magnesium rich surfaces.

The coating formed with a process solution containing at least one pH adjustment agent from this second group may often reveal the same microstructural appearance or even less micropores probably sealed by a coating of silanes/silanols/siloxanes/polysiloxanes. This conversion coating may be hydrophilic or hydrophobic or very hydrophobic depending on the types and amounts of silanes/silanols/siloxanes/polysiloxanes present in the process solution.

The silane/silanol/siloxane/polysiloxane is often here called "silane" to have an easier wording. Preferably, a water-soluble silane may be added that must not be significantly hydrolyzed, but may have been prehydrolyzed prior to its addition to the process solution. There may be added an essentially unhydrolyzed, partially hydrolyzed, mostly hydrolyzed or nearly completely or totally hydrolyzed silane. Nevertheless, this silane may already contain even any content of any silanol or any corresponding silanol or of any siloxane or any corresponding siloxane or any combination of these. On the other hand, there may be primarily added a siloxane or a polysiloxane or any combination of these or any combination of these with at least one silane or with any silanol or any mixture of these. Preferably, such siloxanes or polysiloxanes or any combination of these are relatively short-chained to be able to condens further. The silane used may be a sol-gel-process system and may optionally be cured after application for example at a temperature of at least 180° C. Silica may be generated especially from a sol-gel-process system.

Said at least one alkaline silane is preferably selected from the group consisting of silanes, silanols, siloxanes and polysiloxanes corresponding to silanes having at least one amino group, at least one imino group, at least one ureido group or any combination of these. The silanes will mostly be hydrolyzed to silanols and will form siloxanes or polysiloxanes or both, especially during the drying of the conversion coating.

More preferred, said hydrolyzed alkaline silane is selected from the group consisting of:

aminoalkyltrialkoxysilanes,
aminoalkylaminoalkyltrialkoxysilanes,
triaminofunctional silanes,
bis-trialkoxysilylalkylamines,
(gamma-trialkoxysilylalkyl)dialkylenetriamines,
N-(aminoalkyl)-aminoalkylalkyldialkoxysilanes,
N-phenyl-aminoalkyltrialkoxysilanes,
N-alkyl-aminoisoalkyltrialkoxysilanes,
4-amino-dialkylalkyltrialkoxysilanes,
4-amino-dialkylalkylalkyldialkoxysilanes,
polyaminoalkylalkyldialkoxysilanes,
ureidoalkyltrialkoxysilanes as well as
their corresponding silanols, siloxanes and polysiloxanes.

Much more preferred, said alkaline silane is selected from the group consisting of:

Aminopropyltriethoxysilanes,
aminopropyltrimethoxysilanes,
triaminofunctional silanes,
bis-triethoxysilylpropylamines,
bis-trimethoxysilylpropylamines,
N-beta-(aminoethyl)-gamma-aminopropylethyldimethoxysilanes,
N-beta-(aminoethyl)-gamma-aminopropylmethyldimethoxysilanes,
N-phenyl-aminopropyltriethoxysilanes,
N-phenyl-aminopropyltrimethoxysilanes,
N-ethyl-gamma-aminoisobutyltriethoxysilanes,
N-ethyl-gamma-aminoisobutyltrimethoxysilanes,
4-amino-3,3-dimethylbutyltriethoxysilanes,
4-amino-3,3-dimethylbutyltrimethoxysilanes,
4-amino-3,3-dimethylbutylmethyldiethoxysilanes,
4-amino-3,3-dimethylbutylmethyldimethoxysilanes,
4-amino-3,3-dimethylbutylethyldiethoxysilanes,
4-amino-3,3-dimethylbutylethyldimethoxysilanes,
ureidopropyltriethoxysilanes,
ureidopropyltrimethoxysilanes as well as
their corresponding silanols, siloxanes and polysiloxanes.

Most preferred, the at least one alkaline hydrolyzed silane is selected from the group consisting of:

aminopropyltriethoxysilanes,
aminopropyltrimethoxysilanes,
ureidopropyltriethoxysilanes,
ureidopropyltrimethoxysilanes,
bis-triethoxysilylpropylamines,
bis-trimethoxysilylpropylamines as well as
their corresponding silanols, siloxanes and polysiloxanes.

An addition of aluminum as cations or as at least one compound or as any combination of these, preferably as aluminum fluoride, is necessary for starting the coating process with a fresh process solution as to form a coating of at least one MgAl fluoride or a coating that is a mixture of different compounds containing at least one MgAl fluoride. Probably, such at least one MgAl fluoride is well visible. Probably, the content of magnesium of at least one MgAl fluoride is higher than the content of aluminum. An addition of aluminum seems to be needed if there is no other aluminum source like magnesium alloys having a certain aluminum content to gain aluminum by etching the acidic process solution. According to a further feature of the present invention, aluminum fluoride may optionally be added to the composition. The addition of an aluminum fluoride is recommended when aluminum-free magnesium alloys such as ZK60 or MA-14 are treated.

The concentration of the cations of aluminum or of aluminum compounds or any combination thereof in the process solution calculated as aluminum fluoride $AlF_3$ is preferably in the range from 0.1 to 50 g/l, more preferred in the range from 0.3 to 40 g/l or from 0.5 to 30 g/l, most preferred in the range from 0.7 to 20 g/l, from 0.8 to 10 g/l or from 1 to 8 g/l, especially at least 0.6 g/l, at least 0.9 g/l, at least 1.2 g/L, at least 1.6 g/L, at least 2 g/L, at least or up to 2.5 g/L, at least or up to 3 g/L, at least or up to 3.5 g/L, at least or up to 4 g/L, at least or up to 4.5 g/L, at least or up to 5 g/L, up to 7 g/L, up to 10 g/L, up to 12 g/L, up to 15 g/L, up to 18 g/L, up to 24 g/L, up to 28 g/L, up to 32 g/L or up to 36 g/L or any combination thereof.

The content of magnesium as magnesium cations or as magnesium compounds or any combination of these in the process solution is in many embodiments not added intentionally, even not partially. Typically, the magnesium content of the process solution is mostly or nearly totally or totally derived from etching the magnesium rich metallic surfaces with the acidic process solution. Therefore, the fresh process solution will often contain no magnesium content or only traces of magnesium dependent from the type of water added. The used process solution ("the bath") may further contain a small magnesium content by drag in from the circulation of water having impurities or of used process solutions. The magnesium content may typically be in the range from 0.001 to 50 g/l.

According to a feature of the present invention at least one surfactant may be optionally added to the composition. "Surfactant" shall mean any organic substance that may be used in detergents and that is added for example due to their surface-active properties and which comprises one or more hydrophilic and one or more hydrophobic groups. The said surfactant is preferably selected from the group consisting of amphoteric surfactants, anionic surfactants, cationic surfactants and non-ionic surfactants. The surfactant(s) may more preferred be at least one oligomeric or polymeric compound. In some embodiments, the at least one surfactant added has a molecule of at least one chain of medium length or of long length or even both, that shall mean a chain with 8 to 18 carbon atoms respectively a chain with 20 to 30 carbon atoms. Such medium or long chain surfactants may have a similar effect as the addition of an organic polymer added and may influence the conversion coating to be more homogeneous, to form a thicker coating, to have a better corrosion resistance and paint adhesion as well as to have smaller particles than without such surfactant(s).

In some embodiments, the surfactant(s) added may be surfactant(s) as they are typically used in cleaning in general or in the surface treatment of metallic surfaces. In some other embodiments, additionally or in alternative to such surfactant (s), surfactant(s) is/are added that show(s) at least one chain of a medium or long length in the molecule. Preferably, it will be taken care that by the addition of the at least one surfactant and its content in the process solution, for the selected process conditions, there will not be generated any foam or only a limited amount of foam that is tolerable. If needed there may be further added at least one defoaming agent, especially if there is a high gas development in the process solution.

The process solution may preferably contain the at least one surfactant in a concentration in the range from 0.005 to 3 g/L, more preferred in the range from 0.008 to 2.5 g/L or in the range from 0.01 to 2 g/L, most preferred in the range from 0.012 to 1.5 g/L or in the range from 0.015 to 1 g/L, especially at least 0.018 g/L, at least 0.02 g/L, at least 0.025 g/L, at least 0.03 g/L, at least 0.05 g/L, at least 0.075 g/L, at least 0.1 g/L, at least 0.15 g/L, at least 0.2 g/L, up to 0.5 g/L, up to 0.8 g/L, up to 1.2 g/L or up to 1.8 g/L or in any combination thereof.

The at least one surfactant is preferably selected from the group consisting of amphoteric surfactants, anionic surfactants, non-ionic surfactants and cationic surfactants. The surfactant may be an oligomeric or polymeric compound. "Surfactants" shall mean any organic substance or preparation that may be used in detergents and that are added e.g. due to their surface-active properties and which comprise one or more hydrophilic and one or more hydrophobic groups of such a nature and size that they are capable of forming micelles.

The at least one non-ionic surfactant may be selected from ethoxylated alkylalcohols, ethoxylated-propoxylated alkylalcohols, ethoxylated alkylalcohols with end group locking and ethoxylated-propoxylated alkylalcohols with end group locking, ethoxylated alkylphenols, ethoxylated-propoxylated alkylphenols, ethoxylated alkylphenols with end group locking and ethoxylated-propoxylated alkylphenols with end group locking, ethoxylated alkylamines, ethoxylated alkanic acids and ethoxylated-propoxylated alkanic acids and blockcopolymers as well as alkylpolyglucosides comprising at least one polyethylene oxide block and at least one polypropylene oxide block. According to one feature of the present invention the surfactant(s) may be at least one non-ionic surfactant having 3 to 100 monomeric groups selected from ethylene oxide, propylene oxide monomeric groups or their mixtures, especially with up to 300 carbon atoms or with up to 200 carbon atoms, whereby the long chain may be one chain, a double chain, a multiple of chains, a regular or an irregular arrangement of ethylene oxide monomeric groups, propylene oxide monomeric groups, a block copolymer or their combinations, whereby the chains may be straight chains without or with smaller or bigger side groups, whereby the surfactant may optionally have an alkyl group with 6 to 24 carbon atoms, most preferred polyoxyalkylene ethers.

According to a further feature of the present invention the surfactant(s) may be at least one non-ionic surfactant selected from alkylpolyglucosides having an alkyl group—saturated or unsaturated—with an average number of carbon atoms in the range from 4 to 18 in each chain and having at least one chain which may be independent one from the other a linear or a branched chain and having an average number of 1 to 5 units of at least one glucoside whereby the units of the at least one glucoside may be bound glucosidically to the alkyl group.

Preferably, said surfactant is a non-ionic surfactant having 3 to 100 monomeric groups selected from the group consisting of ethylene oxide monomeric groups and propylene oxide monomeric groups, especially with up to 300 carbon atoms, whereby the long chain may be one chain, a double chain, a multiple of chains, a regular or irregular arrangement of ethylene oxide monomeric groups, propylene oxide monomeric groups, a block copolymer or their combinations, whereby the chains may be straight chains without or with bigger side groups, whereby the surfactant may optionally have an alkyl group with 6 to 24 carbon atoms, especially with 8 to 20 carbon atoms. More preferred, said surfactant is a polyoxyalkylene ether, most preferred a polyoxyethylene ether selected from the group consisting of polyoxyethylene oleyl ethers, polyoxyethylene cetyl ethers, polyoxyethylene stearyl ethers, polyoxyethylene dodecyl ethers, such as polyoxyethylene(10)oleyl ether—commercially sold as Brij® 97.

Preferably, the process solution contains at least one non-ionic surfactant having 3 to 100 monomeric groups selected from ethylene oxide and propylene oxide monomeric groups with up to 15.000 carbon atoms, whereby the surfactant contains at least one long chain that may be a single chain, a double chain, a multiple of chains, a regular or irregular arrangement of ethylene oxide monomeric groups, propylene oxide monomeric groups, a blockcopolymer or any of their combinations, whereby the at least one chain may be a straight chain without or with bigger side groups and whereby the surfactant may optionally have an alkyl group with 6 to 24 carbon atoms.

According to one feature of the present invention the surfactant(s) may be at least one anionic surfactant a) having an alkyl group—saturated or unsaturated—with an average number of carbon atoms in the range from 6 to 24 in each chain and having at least one chain which may be independent one from the other a linear or a branched chain and having optionally an alkyl part of the molecule with one or more aromatic groups and having at least one sulfate group per molecule, at least one sulfonate group per molecule or at least one sulfate group as well as at least one sulfonate group per molecule or b) (ether sulfates) which ethoxylated alkylalcohols resp. ethoxylated-propoxylated alkylalcohols having a sulfate group whereby the alkyl group of the alkylalcohols—saturated or unsaturated—with an average number of carbon atoms in the range from 6 to 24 in each chain and having at least one chain which may be independent one from the other a linear or a branched chain and whereby each ethylene oxide chain may have an average number of 2 to 30 ethylene oxide units, whereby there may be at least one propylene oxide chain having an average number of 1 to 25 propylene oxide units, whereby the alkyl part of the molecule may optionally show one or more aromatic groups, one or more phenolic groups or a mixture of at least one aromatic group and at least one phenolic group or c) (ether phosphates) which ethoxylated alkylalcohols resp. ethoxylated-propoxylated alkylalcohols having a phosphate group whereby the alkyl group of the alkylalcohols—saturated or unsaturated—with an average number of carbon atoms in the range from 6 to 24 in each chain and having at least one chain which may be independent one from the other a linear or a branched chain and whereby each ethylene oxide chain may have an average number of 2 to 30 ethylene oxide units, whereby there may be at least one propylene oxide chain having an average number of 1 to 25 propylene oxide units, whereby the alkyl part of the molecule may optionally show one or more aromatic groups, one or more phenolic groups or a mixture of at least one aromatic group and at least one phenolic group or d) (phosphate esters) which one or two alkyl groups each independent one from the other—saturated or unsaturated—having an average number of carbon atoms in the range from 4 to 18 in each chain and having at least one chain which may be independent one from the other a linear or a branched chain and whereby the alkyl part of the molecule may optionally show one or more aromatic groups, one or more phenolic groups or a mixture of at least one aromatic group and at least one phenolic group, whereby there is one phosphate group in each molecule.

According to another feature of the present invention the surfactant(s) may be at least one amphoteric surfactant which may be selected from the group consisting of amine oxides, betaines and protein hydrolyzates.

More preferred, the at least one surfactant shows at least one alkyl group with an average number of carbon atoms of at least 8, of at least 10 or of at least 12, much more preferred with an average number of carbon atoms of at least 14, of at least 16 or of at least 18, especially in some cases with an average number of carbon atoms of at least 20, of at least 22 or even of at least 24. Further on it is preferred to select a surfactant which shows more polymer-like properties, for example in high concentration a high viscosity.

Preferably, the process solution contains at least one nonionic surfactant which is selected from alkylpolyglucosides having an alkyl group—saturated or unsaturated—with an average number of carbon atoms in the range from 4 to 18 in each chain and having at least one chain which may be independent one from the other, which may be a linear or a branched chain and whereby the surfactant has an average number of 1 to 5 units of at least one glucoside, whereby the units of the at least one glucoside may be bound glucosidically to the alkyl group.

More preferred, the process solution contains at least one surfactant that is selected from the group consisting of polyoxyethylene oleyl ethers, polyoxyethylene cetyl ethers, polyoxyethylene stearyl ethers and polyoxyethylene dodecyl ethers, especially at least one a polyoxyalkylene ether, most preferred at least one polyoxyethylene(10)oleyl ether.

Alternatively or additionally, the process solution may preferably contain at least one anionic surfactant having an alkyl group—saturated or unsaturated—with an average number of carbon atoms in the range from 6 to 24 in each chain and having at least one chain which may be independent one from the other being a linear or a branched chain and having optionally an alkyl part of the molecule with one or more aromatic groups and having at least one sulfate group per molecule, at least one sulfonate group per molecule or at least one sulfate group and at least one sulfonate group per molecule.

Nevertheless, there are a lot of possible variations of the compositions of the present invention by adding at least one further component. The process solution which is a solution or dispersion, may additionally contain any sol, any gel, any colloid, any particles, any nanoparticles or any combination of these. The sol, gel, colloid or any combination of these contained in the process solution may preferably be on a base of silicon compounds, aluminum compounds, titanium compounds, zirconium compounds and any combination of these. The particles or nanoparticles or both to be added are preferably inorganic, more preferred these are selected from the group consisting of carbides like silicon carbide, nitrides like boron nitride, lubricants like molybdenum sulfide, oxides like alumina, silica, titania and zirconia as well as silicates. On the other hand, fine particles of a fluoropolymer like PTFE may be added to the process solution, too.

There may be further added to the process solution at least one oligomer, polymer, copolymer, blockcopolymer or any mixture of them which may be each organic or inorganic, for example on the base of amorphous silicas, amorphous silicates, silanes, siloxanes, polysiloxanes, fluor containing polymers like PTFE, molybdenum compounds, niobium compounds, tungsten compounds, organic resins like acrylic constituents containing resins or resin mixtures, electrically conductive polymers or their mixtures like compounds on the base of polyaniline, polypyrrol, polythiophene or any combination of these.

There is also provided according to the teachings of the present invention a method of treating a workpiece having a surface of magnesium and magnesium alloys by immersing (=dipping) the surface in the process solution or by spraying the process solution on the said surface or application of the process solution by rolling (=rollcoating) without or with squeegeeing of the said surface wherein the process solution is substantially as described herein above.

According to one feature of the present invention, the process solution is maintained at a temperature in the range from 10° C. to 70° C. during its application to the magnesium rich surfaces or any other surfaces or both, more preferred in the range from 15° C. to 60° C., most preferred in the range from 20° C. to 50° C. Preferably, the process solution is applied on the metallic surfaces for a time in the range from 0.01 to 30 min, more preferred in the range from 0.1 to 20 minutes, most preferred in the range from 0.2 to 15 minutes.

For most applications, the exposition time is preferably in a range from 0.5 to 10 minutes which is often sufficient. The coating thickness obtained during this exposition time varies from about 1 to about 50 microns. The coating rate may often vary in the range from 2 to 7 μm per minute. Nevertheless, the precise coating building rate depends on the type of magnesium alloy to be treated and on the specific parameters of the process solution. Astonishingly, the formation of thicker coatings is also possible, even coatings with a thickness of up to 80, up to 100, up to 120 or even up to 150 μm. Even such thick coatings showed an excellent adhesion on metallic surfaces. However, coating thicknesses in the range from about 3 to about 15 microns are often sufficient for the intended industrial applications.

The concentration of magnesium and aluminum in the process solution may be regulated by the temperature of the process solution and by the solubility of the magnesium fluorides and aluminum fluorides including complex fluorides of aluminum.

The term "magnesium alloys" includes but is not limited to alloys like AM50, AM60, AS41, AZ31, AZ60, AZ61, AZ80, AZ81, AZ91, HK31, HZ32, EZ33, MA14, QE22, ZE41, WE54, WE43, AZM, ZH62, ZK40, ZK51, ZK60, ZM21, ZW3, MA2, MA22, MA20, RS92, MRI153, MRI230, MRI201 and MRI202.

In many embodiments, there may be prior to the coating of the metallic surfaces of the workpiece with the process solution a treatment of the metallic surfaces with at least one cleaning solution, with at least one deoxidizer solution or with at least one cleaning solution and with at least one deoxidizer solution. In between, preferably before or after the application of the process solution, there may be at least one rinsing with water, especially with very pure water qualities. The cleaning may be performed with an acidic or with an alkaline cleaning solution, but often there is performed an alkaline cleaning or an acid etching or any combination thereof.

There may be at least one further treatment of the coated metallic surface of the workpiece with at least one further applied coating selected from the group consisting of coatings prepared from a solution, dispersion or emulsion containing at least one silane, silanol, siloxane, polysiloxane or any combination thereof or being prepared from a dispersion or solution containing at least one organic resin like a paint, from a powder paint, from fluoropolymers, from e-coats, from self-lubricant(s) containing composition, from adhesives or any combination thereof applied one after the other.

A special improvement of the typically very low corrosion resistance of fluoropolymer(s) containing coatings applied on top of the conversion coating on magnesium rich metallic surfaces was observed: It can be obtained by post-rinsing (=sealing) the coatings containing for example PTFE with compositions containing at least one compound selected from the group consisting of silanes, silanols, siloxanes and polysiloxanes. Examples of said solutions may preferably be solutions containing bis-trialkoxysilylpropyl polysulfane, fluoroalkyl silane, any corresponding siloxane, any corresponding polysiloxane or any combination of these.

With the aid of the process solution according to the invention, well visible non-chromate conversion coatings are obtained. They often have a mat grey non-metallic appearance. The color of these coatings varies mostly from light grey for example of aluminum-poor compositions as they may occur on aluminum-poor metallic surfaces like that of AZ31 to dark grey and to black. A coating of a dark grey color may occur if the aqueous composition respectively the coating has a certain content of aluminum as upon AZ80 or AZ91. On the aluminum-free metallic surface of ZK60, the coating is dark grey. Some magnesium alloys developed from the Magnesium Research Institute at Beer-Sheba in Israel called MRI alloys like MRI153 containing rare earth metals allow the generation of a black coating. The specific color depends predominantly on the alloy that has been treated. The non-chromate conversion coating of the present invention may have a complicate composition containing predominantly atoms of Mg, Al and F as well as in many embodiments even Si.

Nevertheless, the composition of the coating generated depends on the magnesium alloy that has been treated. The coating may also include in some embodiments a residue of pH adjustment agent(s), of surfactant(s) or any combination of these. There may be present in the coating small amounts of impurities like cations and inorganic compounds coming from impurities of the process solution.

It is clear for an expert in the art that any interaction between the surface of magnesium or of any magnesium alloy with the process solution of the present invention results in a dissolution of constituents of said metallic surface by etching with the acidic process solution and in an increasing concentration for example of the alloyed metals in the process solution.

It is preferred that the process solution is essentially free of or free of any components like a sequestering agent, like a chelant like EDTA, like any oxidizing agent as on the base of peroxides, like any carboxylate like a citrate, like any further additive like a biocide or any combination thereof that might be favorable for the process solution or for the coating formed thereof or both, but in some embodiments it may be helpful to add at least one defoaming agent. Furthermore, it is more preferred that there is not intentionally added to the process solution any such compound as mentioned just before. For most of the embodiments, it is preferred that there is not intentionally added any type of cation of metals or any corresponding compound or any combination thereof selected from the group consisting of cadmium, chromium, cobalt, copper, lead, molybdenum, nickel, niobium, tantalum, tungsten and vanadium.

Nevertheless, it is more preferred to add only a small content or even no components that are environmentally unfriendly. On the other hand, there may be small amounts of impurities coming from chemical reactions with the workpieces, apparatuses, tubes and electrodes as well as from the drag in from other tanks and from tubings.

In many embodiments, there is subsequent to said forming of the conversion coating with the process solution a process step e), f), g), h), i) or any combination thereof in alphanumerical order for applying a composition containing at least one organic polymeric compound to the coated surface, wherein the composition is selected from the group consisting of paints, electrocoating paints (=e-coats), powder paints, self-lubricant(s) containing compositions, adhesives and rubber polymers.

Further on, in many embodiments, there is subsequent to said forming of the coating with said process solution a process step e) or f) for applying at least one silane/silanol/siloxane/polysiloxane containing liquid sealing composition or at least one composition containing at least one self-lubricant to the surface already coated with the process solution or to the surface of the coating applied further thereon or any combination of these. If there should be applied more than one composition, they are applied one after the other, f) after e). The "silane/silanol/siloxane/polysiloxane" will often be called "silane" to have an easier wording. Said at least one silane/silanol/siloxane/polysiloxane containing sealing composition may preferably contain at least one compound selected from the group consisting of:

bis-trialkoxysilylpropyl polysulfanes, fluoroalkyl silanes and their corresponding silanols, siloxanes and polysiloxanes.

In many embodiments, there is further on subsequent to said forming of the coating with said process solution a process step e) or f) for applying at least one fluoropolymer containing composition to said surface. With such a composition which may be a solution, a dispersion or an emulsion and which may contain water, at least one organic solvent or both, a fluoropolymer coating may be formed that may preferably have a coating thickness in the range from 1 to 40 μm, more preferred in the range from 5 to 35 μm, most preferred in the range from 10 to 30 μm. The coating thickness may be dependent on the further constituents of the composition, on the kind of application and on the particle sizes of the fluoropolymer used. Such coating may render antifriction properties to the coated article. The fluoropolymer containing composition may preferably be applied for example by spraying or dipping, although all types of application may be used. If a fluoropolymer coating is to be applied, it is preferred that the process solution does not contain any silane/silanol/siloxane/polysiloxane and that there is no silane sealing composition applied before the application of the fluoropolymer if a hydrophilic baseground for the fluoropolymer is intended.

Preferably, with the fluoropolymer composition at least one polytetrafluoroethylene (PTFE) polymer may be applied. The fluoropolymer composition may contain fluoropolymer particles that are preferably of a mean particle size below 1 μm. The fluoropolymer containing coating and especially the PTFE coating should be cured. The curing of a PTFE coating may preferably be performed at temperatures in the range from 10 to 400° C., depending on the type of PTFE composition and on the type of curing selected. Often, such curing is performed at a temperature range from 200 to 300° C., especially at these temperatures for a time of 1 to 30 minutes. If a low temperature curing would be carried out, especially at room temperatures, this may take few hours of time.

Preferably, the fluoropolymer composition is maintained at a temperature in the range from 10° C. to 90° C. during its application to the surfaces of the conversion coating or any other surface, more preferred in the range from 15° C. to 75° C., most preferred in the range from 20° C. to 60° C. Preferably, the fluoropolymer composition is applied on the metallic surfaces for a time in the range from 0.05 to 8 min, more preferred in the range from 0.1 to 5 minutes, most preferred in the range from 0.2 to 3 minutes. Preferably, the fluoropolymer composition is applied by dipping, by spraying or by any combination thereof.

Preferably, in many embodiments, a sealing composition may further be applied to the fluoropolymer coating which is an aqueous solution or dispersion and which comprises at least one silane/silanol/siloxane/polysiloxane. Preferably, the sealing composition contains at least one partially hydrolyzed silane or at least one siloxane or at least one polysiloxane or any combination thereof. In many embodiments, this sealing composition is an aqueous solution, an aqueous dispersion, an emulsion or any combination of these. The sealing composition may contain a low or a high content of organic solvent. If the fluoropolymer coating which renders antifriction properties should even show a certain corrosion resistance, then it is preferred to apply a sealing composition to the fluoropolymer coating. Such sealing composition contains preferably at least one silane/silanol/siloxane/polysiloxane of a low or even of a high hydrophobicity. This sealing composition may preferably contain at least one silane/silanol/siloxane/polysiloxane that is selected from the group consisting of:

bis-trialkoxysilylpropyl polysulfanes, silanes containing at least one fluoroalkyl group and their corresponding silanols, siloxanes and polysiloxanes.

Preferably, the silane containing sealing composition is maintained at a temperature in the range from 10° C. to 40° C. during its application to the surfaces of the conversion coating, to the surfaces of the fluoropolymer coating or to any other surface, more preferred in the range from 15° C. to 35° C., most preferred in the range from 20° C. to 40° C. Preferably, the silane containing sealing composition is applied on the coated surfaces for a time in the range from 0.05 to 8 min, more preferred in the range from 0.1 to 5 minutes, most preferred in the range from 0.2 to 3 minutes. Preferably, the silane containing sealing composition is applied by dipping, by spraying, by brushing, by rollcoating or by any combination thereof.

The well visible non-chromate conversion coating according to the invention may show a composition comprising at least one metal compound whereby the at least one metal is selected from the metals contained in the magnesium or magnesium alloy surface and comprising further fluor and aluminum and optionally silicon.

It was astonishing that in a chemical system that similarly does not form any coating or any well visible coating may form such well visible coatings on magnesium rich surface. It was further astonishing that a process solution with a so non-complicate composition offers the ability to form a visible coating with excellent adhesion to a paint coating, to a powder coating, to an e-coat, to a fluoropolymer coating, to a self-lubricant(s) containing layer or to an adhesive(s) containing layer. It was astonishing that well visible coatings were obtained without any addition of permanganic acid, of tannine or of an organic dye that are usually used for the coloring of non-chromate conversion coatings. It was astonishing to form conversion coatings on magnesium rich surfaces that have such a high adhesion to paints and similar coating materials formed with a process solution containing fluorosilicon acid which results in paint adhesion qualities that are higher for a factor of about 1.5 than if in an analogous way a coating would have been applied with fluorotitanium acid or with fluorozirconium acid on such magnesium rich surfaces. It was finally astonishing that there is a possibility to form such thick coatings which may have a thickness of even more than 100 μm without any specific and expensive equipment like in anodizing technology. The high coating thickness may be important for thermal insulation, for wear protection and for flammability protection of such coated articles.

EXAMPLES AND COMPARISON EXAMPLES

Example 1 and Comparison Example 1

Corrosion Resistance and Paint Adhesion of a Conversion Coating Covered with a Wheel Paint System Three specimens each of extruded rods that are cut to disks of AZ80 magnesium alloy were cleaned in the strong alkaline cleaner Gardoclean® S5192 available from Chemetall GmbH and were then coated in a process solution of the present invention for 5 minutes which is the composition as described in Table 1 as process solution 2 (Example 1). During this time, dark grey mat non-metallic coatings of 20 to 25 μm thickness were generated. The surfaces of these coatings were very even and homogeneous. The specimens were then painted with a wheel paint system consisting of the following three layers:

1. Powder primer Akzo Nobel EP 000 D of about 70 μm thickness;
2. Silver base coat wet paint Stollaquid G 1152 of Du Pont of about 28 μm thickness;
3. Clear coat acrylic powder paint 90-60-0005 of Rohm & Haas of about 30 μm thickness.

Another set of three disks of AZ80 was cleaned in the same cleaner solution as mentioned above. Then, these specimens were pretreated with a chromate conversion coating composition Dow® 20 generating bright yellow chromate layers of 1.5 to 2 μm thickness. Afterwards, the such coated specimens were painted with the same paint system as described above (Comparison Example 1).

Both types of specimens were then scratched unto the magnesium alloy surface and tested in a salt-spray test in accordance with DIN 50021 for 240 hours. The results of the salt-spray test were evaluated in accordance with DIN 53210. The specimens that had been pretreated with the chromate conversion coating showed a corrosion sensitivity disclosed by a creepage of 2 to 4 mm in scribe (Comparison Example 1). The specimens pretreated by the non-chromate conversion solutions according to the present invention (Example 1) showed a very low corrosion sensitivity by a creepage of only 1 mm in scribe and a very high adhesion because of the microroughness of the conversion coating.

Example 2

Corrosion Resistance and Paint Adhesion with an e-coat

Three dye-cast panels each of AZ91 magnesium alloy were cleaned in Gardoclean® S5192 available from Chemetall GmbH. These specimens were then coated in a process solution of the present invention having the composition of process solution 2 as described in Table 1 for 5 minutes, thereby generating non-chromate conversion coatings of 20 to 25 μm thickness and of a dark grey color with changing grey shadows and a mat non-metallic appearance. The surfaces of these coatings were very even and showed a certain microroughness, but were a bit less homogeneous probably because the material of the substrate was not as homogeneous. The such coated specimens were then painted with an electrocoating paint (e-coat) Cathoguard 400 of BASF generating a paint thickness of about 30 μm. Astonishingly, these specimens showed an unusually homogeneous and fine appearance of the e-coat which is normally very difficult to reach for magnesium alloys. These specimens were then scratched unto the magnesium alloy surface and were tested in a salt-spray test in accordance with DIN 50021 for 240 hours.

The test results were evaluated in accordance with DIN 53210. The specimens showed an extraordinary low corrosion sensitivity by a creepage of even less than 1 mm in scribe and a very high adhesion because of the microroughness of the conversion coating.

Comparison Example 2

Treatment of an Aluminum Alloy as in Example 2

A set of three panels of aluminum alloy A6061 were treated in the exactly same manner as for Example 2. The process solution used was fresh and had the same composition as in Example 2. The surfaces of the treated panels looked as if there was only an etching, but there was no or nearly no coating. If any conversion coating should have been formed, this coating is totally clear and totally colorless. There occurred only a small amount of "smut", a black powder that may be partially removed by wiping which is typical for the etching of aluminum alloys. These specimens were not e-coated because of the residual smut and because of the general occurrence of bad coatings and bad coating properties of coatings applied to conversion coatings showing smut as such e-coat will often be easily peeled off.

Examples 3 and 4, Comparison Example 3

Corrosion Resistance After Coating with a PTFE Coating and for Example 4 Additionally with a Silane Based Sealing Three sets of dye-cast panels of AZ91 magnesium alloy were cleaned in Gardoclean® S5192 available from Chemetall GmbH.

The first three specimens (Comparison Example 3) were then treated at about 58° C. with a commercial aqueous amorphous $Fe^{2+}$ and alkali metal ions containing phosphate solution of a pH of about 3.6 available from AMZA Ltd. thereby generating alkali metal phosphate coatings of about 1 μm thickness and of a bluish to grey color, but they did not show a microroughness.

The six other specimens (Examples 3 and 4) were coated with the fresh process solution 2 according to Table 1. During the contacting time of 5 minutes, dark grey mat non-metallic coatings of 20 to 25 μm thickness were formed. The surfaces of these coatings were very even, a bit inhomogeneous and showed a microroughness that is helpful to improve the paint adhesion.

All nine specimens were then, after drying, coated by spraying an emulsion of Xylan® 1010 PTFE available from Whitford Ltd. to generate PTFE coatings on the very even microrough conversion coatings. These coatings were cured at about 240° C. for 22 minutes.

Then, the specimens of Example 4 were additionally sealed in a silane based solution of OXSILAN® MG 0611 available from Chemetall GmbH to generate further sealings of about 0.5 to 1.1 μm thickness.

All nine such coated specimens were then tested in a salt-spray test in accordance with DIN 50021 until the first occurrence of any corrosion pitting. The specimens of Comparison Example 3 showed the first corrosion pits already after 24 hours, whereas the other specimens revealed first corrosion pits after 48 hours (Example 3) respectively after 216 to 336 hours (Example 4).

Examples 5 to 9, Comparison Example 4

Bare Corrosion Resistance of Coated Magnesium Alloy AZ91

Three dye-cast panels each of AZ91 magnesium alloy were cleaned in Gardoclean® S5192 available from Chemetall GmbH. These specimens were then coated in a process solution of the present invention having a composition as described in Table 1 as process solutions 1 to 6 for 5 minutes each.

TABLE 1

Composition and pH of the process solutions used and bare corrosion results

| | Example/Comp. Ex. | | | | | |
|---|---|---|---|---|---|---|
| | Ex. 5 | Ex. 6 | Ex. 7 | Cp. Ex. 4 | Ex. 8 | Ex. 9 |
| Process solution No. | 1 | 2 | 3 | 4 | 5 | 6 |
| $H_2SIF_6$, g/l | 20 | 35 | 30 | 10 | 25 | 35 |
| $NH_4OH$, g/l | 48 | 25 | — | — | — | 35 |
| KOH, g/l | — | — | 40 | — | — | — |
| Silane, g/l | — | — | — | 24 | 24 | — |
| $AIF_3$, g/l | — | 1.96 | 3.92 | 1.96 | — | 3.92 |
| $H_3BO_3$, g/l | — | — | — | — | — | 9.8 |
| pH | 2.5 | 1.5 | 1.4 | 5.5 | 3.0 | 2.0 |

TABLE 1-continued

Composition and pH of the process solutions used and bare corrosion results

| | Example/Comp. Ex. | | | | | |
|---|---|---|---|---|---|---|
| | Ex. 5 | Ex. 6 | Ex. 7 | Cp. Ex. 4 | Ex. 8 | Ex. 9 |
| Coating thickness, μm | 20 to 25 | 20 to 25 | 20 to 25 | <1 | about 10 | 20 to 25 |
| Coating visibility | well visible | well visible | well visible | invisible | well visible | well visible |
| Bare corrosion in % | 80-100 | 80-100 | 80-100 | 40-60 | 1-20 | 80-100 |

The silane added is an amino-functional trialkoxysilane that was not prehydrolyzed. With the process solutions of Table 1 non-chromate conversion coatings of the Examples 5 to 9 were generated of about 20 to 25 μm for the silane-free process solutions and of about 10 μm thickness for the silane containing process solutions. Comparison Example 4 showed a clear and colorless coating of less than 1 μm thickness, probably because of a too high content of a silane in the process solution so that there is mainly formed a siloxane/polysiloxane coating that contained no or only a small amount of fluorides. The coatings of the Examples 5 to 8 showed a dark grey color with changing grey shadows and a mat non-metallic appearance. The coatings of Example 9 have a light grey color with changing grey shadows and a mat non-metallic appearance, because of the boron content. The surfaces of all these coatings of the Examples 5 to 9 were very even and showed a certain microroughness, but a bit less homogeneous appearance, probably because the material of the substrate was not as homogeneous. The bare corrosion resistance tested with a salt-spray test according to DIN 50021 and evaluated in accordance with DIN 53210 showed after 24 hours of testing a corroded surface that had a corrosion pitting of 1 to 20% of the surface area of the panel for Example 8, of 40 to 60% for Comparison Example 4 and of 80 to 100% for the Examples 5 to 7 and 9. Nevertheless, such a severe corrosion test of a generally very corrosion sensitive metallic material, the results of the bare corrosion test are good and sometimes even very good.

The coatings of samples of Example 6 were investigated by X-ray analysis and by electron microprobe analysis. The X-ray results indicate the presence of at least one compound containing aluminum, magnesium, fluoride and at least one further cation as well as an amorphous silica. The microprobe revealed a homogeneous contribution of Mg in the coating as well as surface areas of the coating with an increased content of Si and O or Si, O and F or Al and F besides of the background of Mg.

Example 10

Corrosion Resistance of a Silane Based Sealing

Two die-cast panels of AZ91 magnesium alloy were cleaned by spraying with Gardoclean® S5192 available from Chemetall GmbH and were then coated by dipping into the process solution 2 of Table 1 according to the invention for 5 minutes. The obtained coating was dark grey and showed a thickness of 20 to 25 μm. Then one of the panels was sealed with the sealing solution OXSILAN® MG 0611 available from Chemetall GmbH which was much diluted and into which the panels were dipped to form a sealing of about 0.6 μm thickness. The other two specimens were tested in a salt-spray test in accordance with DIN 50021 for 24 hours. The test results were evaluated in accordance with DIN 53210. The unsealed specimens were corroded to 80 to 100% of the surface area. The silane sealed specimen was only corroded to 1 to 20% of the surface area which is an excellent result. The sealed surface as seen under a scanning electron microscope is shown in FIG. 2.

The invention claimed is:

1. A process for forming a non-chromate conversion coating on surfaces of magnesium or magnesium alloys comprising the steps of:

providing clean surface of magnesium or a magnesium alloy;

contacting said surface with a process solution;

whereby said process solution is an aqueous solution or an aqueous dispersion having a pH in the range from 0.5 to 3 and comprising:

at least one fluorosilicon acid in the range of from 4 to 100 g/L, at least one water-soluble pH adjustment agent, wherein the at least one water-soluble pH adjustment agent is at least one alkaline silicon compound selected from the group consisting of a silane, a silanol, a siloxane and a polysiloxane, which has at least one of an amino group, an ureido group or an imino group, wherein the non-chromate conversion coating is formed with the aid of the process solution and wherein the non-chromate conversion coating is light gray to black.

2. The process of claim 1, the process solution further comprises pH adjustment agent selected from the group consisting of $NH_4OH$, LiOH, NaOH, KOH, $Ca(OH)_2$, at least one amine compound, an amide, an imine, and an imide.

3. The process of claim 1, wherein the at least one water soluble pH adjustment agent is selected from the group consisting of:

an aminoalkyltrialkoxysilane, an aminoalkylaminoalkyltrialkoxysilane, a triaminofunctional silane, a bis-trialkoxysilylalkylamine, a (gamma-trialkoxysilylalkyl)dialkylentriamine, a N-(aminoalkyl)-aminoalkylalkyldialkoxysilane, a N-phenyl-aminoalkyltrialkoxysilane, a N-alkyl-aminoisoalkyltrialkoxysilane, a 4-amino-dialkylalkyltrialkoxysilane, a 4-amino-dialkylalkyldialkoxysilane, a polyaminoalkylalkyldialkoxys, an ureidoalkyltrialkoxysilane and corresponding silanols, siloxanes and polysiloxanes thereof.

4. The process of claim 1, wherein the process solution further comprises at least one surfactant selected from the group consisting of an amphoteric surfactant, an anionic surfactant, a cationic surfactant and a non-ionic surfactant that have a molecule of at least one chain of medium length or of long length.

5. The process of claim 1, wherein the process solution contains at least one surfactant that is selected from the group consisting of polyoxyethylene oleyl ethers, polyoxyethylene cetyl ethers, polyoxyethylene stearyl ethers and polyoxyethylene dodecyl ethers.

6. The process of claim 1, wherein the process solution contains at least one polyoxyalkylene ether.

7. The process of claim 1, wherein the process solution contains at least one of aluminum cations or aluminum compounds in a concentration in the range from 0.1 to 50 g/l calculated as aluminum fluoride $AlF_3$.

8. The process of claim 1, wherein the process solution contains a cation of or a compound comprising at least one of boron, titanium, hafnium or zirconium.

9. The process of claim 1,wherein the surfaces are treated with at least one acidic etching solution, with at least one cleaning solution, with at least one deoxidizer solution, or with at least one cleaning and with at least one deoxidizer solution prior to contacting the surface with the process solution.

10. The process of claim 1, wherein at least one rinsing solution is applied to the surface prior to or after contact of the surface with the process solution.

11. The process of claim 1, further comprising the step of applying a composition containing at least one organic polymeric compound to the coated surface, wherein the polymeric compound is selected from the group consisting of a paint, an electrocoating paint, a powder paint, a self-lubricant containing composition an adhesive and a rubber polymers.

12. The process of claim 1, wherein liquid sealing composition or at least one self-lubricant containing composition is applied to the surface after coating with the process solution, wherein the liquid sealing composition or the at least one self-lubricant containing composition comprises at lest one silane, silanol, siloxane or polysiloxane.

13. The process of claim 1, wherein there is subsequent to the forming of the conversion coating with the process solution a process step e) or f) for applying at least one fluoropolymer containing composition to the coated surface.

14. The process of claim 1, wherein a fluoropolymer composition containing at least one polytetrafluoroethylene polymer is applied.

15. The process of claim 1, further comprising applying a sealing composition to the conversion coating or to the fluoropolymer coating wherein the sealing composition is an aqueous solution, dispersion or emulsion and comprises at least one silane, silanol, siloxane or polysiloxane.

16. The process of claim 1, wherein a sealing composition is applied after coating with the process solution, wherein the sealing composition comprises a member selected from the group consisting of:

a bis-trialkoxysilylpropyl polysulfane, a silane containing at least one fluoroalkyl group, a silanol thereof, a siloxane thereof and a polysiloxane thereof.

17. The process of claim 1, wherein the process solution is maintained at a temperature in the range from 10° C. to 70° C. during its application to the metallic surface.

18. The process of claim 1, wherein the process solution is applied on the metallic surface for a time period in the range from 0.5 to 25 mm.

19. The process of claim 1, wherein a fluoropolymer composition is also applied.

20. The process of claim 1, wherein a silane containing sealing composition is applied.

21. The process of claim 1, further comprising applying a lubricant or a composition containing a lubricant or being effective as a lubricant is further on applied.

22. A non-chromate conversion coating produced by a process as claimed in claim 1.

23. A non-chromate conversion coating as claimed in claim 22 having a composition comprising at least one metal compound whereby the at least one metal is selected from the metals contained in the magnesium or magnesium alloy surface and comprising further fluorine and aluminum.

24. An article of manufacture comprising a metallic surface comprising of magnesium or of any magnesium alloy which is coated with at least one coating which prepared by the process of claim 1.

25. The process of claim 1, wherein the non-chromate conversion coating has a thickness of from 3 to 80 μm.

26. A process for forming a non-chromate conversion coating on surfaces of magnesium or magnesium alloys comprising the steps of:

providing clean surface of magnesium or a magnesium alloy;

contacting said surface with a process solution;

whereby said process solution is an aqueous solution or an aqueous dispersion having a pH in the range from 0.5 to 3 and comprising:

at least one fluorosilicon acid in the range of from 4 to 100 g/L, at least one water-soluble pH adjustment agent, whereby the at least one water-soluble pH adjustment agent is at least one alkaline silicon compound selected from the group consisting of a silane, a silanol, a siloxane and a polysiloxane, which has at least one of an amino group, an ureido group or an imino group, wherein the non-chromate conversion coating is formed with the aid of the process solution, wherein the process solution contains at least one non-ionic surfactant having 3 to 100 monomeric groups selected from ethylene oxide and propylene oxide monomeric groups with up to 15,000 carbon atoms, whereby the surfactant contains at least one long chain that may be a single chain, a double chain, a multiple of chains, a regular or irregular arrangement of ethylene oxide monomeric groups, propylene oxide monomeric groups, a blockcopolymer or any combination thereof, whereby the at least one chain may be a straight chain without or with bigger side groups and whereby the surfactant may optionally have an alkyl group with 6 to 24 carbon atoms and wherein the non-chromate conversion coating is light gray to black.

27. The process of claim 26, wherein the non-chromate conversion coating has a thickness of from 3 to 80 μm.

28. A process for forming a non-chromate conversion coating on surfaces of magnesium or magnesium alloys comprising the steps of:

providing clean surface of magnesium or a magnesium alloy, contacting said surface with a process solution;

whereby said process solution is an aqueous solution or an aqueous dispersion having a pH in the range from 0.5 to 3 comprising:

at least one fluorosilicon acid in the range of from 4 to 100 g/L, at least one water-soluble pH adjustment agent, whereby the at least one water-soluble pH adjustment agent is at least one alkaline silicon compound selected from the group consisting of a silane, a silanol, a siloxane and a polysiloxane, which has at least one of an amino group, an ureido group or an imino group, whereby the non-chromate conversion coating is formed with the aid of the process solution, wherein the process solution contains at least one non-ionic surfactant selected from alkylpolyglucosides having C4-C18 unsaturated or saturated alkyl group and having at least one chain which is, independent one from the other, which may be a linear or a branched chain and whereby the surfactant has an average number of 1 to 5 units of at least one glucoside, whereby the units of the at least one glucoside are bound glucosidically to the alkyl group.

29. The process of claim 28, wherein the non-chromate conversion coating has a thickness of from 3 to 80 μm.

30. A process for forming a non-chromate conversion coating on surfaces of magnesium or magnesium alloys comprising the steps of:

a) providing clean surfaces of magnesium or magnesium alloys, b) contacting said surfaces with a process solution, c) whereby said process solution is an aqueous solution or an aqueous dispersion having a pH in the range from 0.5 to 3 and comprising:

at least one fluorosilicon acid; and at least one water-soluble pH adjustment agent, wherein the water-soluble pH adjustment agent comprises at least one silicon compound selected from the group consisting of a silane, a silanol, a siloxane and a polysiloxane, wherein the non-chromate conversion coating is formed with the aid of the process solution and wherein the non-chromate conversion coating is light gray to black.

31. The process of claim 30, wherein the concentration of the at least one fluorosilicon acid in the solution is in the range from 1 to 100 g/l.

32. The process of claim 30, wherein the pH adjustment agent further comprises $NH_4OH$, LiOH, NaOH, KOH, $Ca(OH)_2$, at least one compound on the base of any amine, at least one compound on the base of any imine or at least one compound on the base of an amide.

33. The process of claim 30, wherein the pH adjustment agent has at least one amino group, at least one ureido group, at least one imino group or having any mixture of these groups.

34. The process of claim 30, wherein the pH adjustment agent is selected from the group consisting of:

aminoalkyltrialkoxysilanes, aminoalkylaminoalkyltrialkoxy-silanes, triaminofunctional silanes, bis-trialkoxysilylalkylamines, (gamma-trialkoxysilylalkyl)dialkylentriamines, N-(aminoalkyl)-amino-alkylalkyldialkoxysilanes, N-phenyl-aminoalkyltrialkoxysilanes, N-alkyl-amino-isoalkyltrialkoxysilanes, 4-amino-dialkylalkyltrialkoxysilanes, 4-amino-dialkyl-alkylalkyldialkoxysilanes, polyaminoalkylalkyldialkoxysilanes, ureidoalkyl-trialkoxy-silanes and corresponding silanols, siloxanes and polysiloxanes thereof.

35. The process of claim 30, wherein the pH adjustment agent is added in an amount needed to adjust the pH of the process solution to a value in the range from 0.8 to 3.

36. The process of claim 30, wherein the at least one surfactant is selected from the group consisting of amphoteric surfactants, anionic surfactants, cationic surfactants and non-ionic surfactants that have a molecule of at least one chain of medium length or of long length.

37. The process of claim 30, wherein the process solution contains at least one non-ionic surfactant having 3 to 100 monomeric groups selected from ethylene oxide and propylene oxide monomeric groups with up to 15,000 carbon atoms.

38. The process of claim 30, wherein the surfactant is present and is a non-ionic surfactant.

39. The process of claim 30, wherein the process solution contains at least one surfactant that is selected from the group consisting of polyoxyethylene oleyl ethers, polyoxyethylene cetyl ethers, polyoxyethylene stearyl ethers and polyoxyethylene dodecyl ethers.

40. The process of claim 30, wherein the process solution contains at least one polyoxyalkylene ether.

41. The process of claim 30, wherein the process solution contains the at least one surfactant in a concentration in the range from 0.005 to 3 g/l.

42. The process of claim 30, wherein the process solution contains aluminum cations or aluminum compounds or any combination of these in a concentration in the range from 0.1 to 50 g/l calculated as aluminum fluoride $AlF_3$.

43. The process of claim 30, wherein there may be added to or contained in the process solution an amount of cations or of at least one compound or any combination thereof selected from the group consisting of boron, titanium, hafnium and zirconium.

44. The process of claim 30, wherein there is prior to the coating of the surfaces with the process solution a treatment of the surfaces with at least one acidic etching solution, with at least one cleaning solution, with at least one deoxidizer solution or with at least one cleaning and with at least one deoxidizer solution.

45. The process of claim 30, wherein at least one rinsing solution or a silane containing sealing composition is applied prior to or after the application of the process solution.

46. The process of claim 30, wherein subsequent to the forming of the non-chromate conversion coating a composition containing at least one organic polymeric compound is applied to the non-chromate coated surface, wherein the organic polymer compound is selected from the group consisting of paints, electrocoating paints, powder paints, self-lubricant containing compositions, adhesives and rubber polymers.

47. The process of claim 30, wherein subsequent to forming the non-chromate conversion coating at least one liquid sealing composition or at least one self-lubricant containing composition is applied to the non-chromate conversion coated surface.

48. The process of claim 30, wherein subsequent to the forming of the non-chromate conversion coating at least one fluoropolymer containing composition is applied to the non-chromate conversion coated surface.

49. The process of claim 30, wherein a fluoropolymer composition containing at least one polytetrafluoroethylene polymer is applied.

50. The process of claim 30, wherein a sealing composition is further applied to the conversion coating whereby the sealing composition is an aqueous solution, dispersion or emulsion or any combination thereof which comprises at least one silane, silanol, siloxane or polysiloxane.

51. The process of claim 30, further comprising applying a sealing composition containing at least one silane compound selected from the group consisting of:

bis-trialkoxysilylpropyl polysulfanes, silanes containing at least one fluoroalkyl group and corresponding silanols, siloxanes and polysiloxanes thereof.

52. The process of claim 30, wherein the process solution is maintained at a temperature in the range from 10° C. to 70° C. during its application to the metallic surfaces.

53. The process of claim 30, wherein the process solution is applied on the metallic surfaces for a time in the range from 0.5 to 25 min.

54. The process of claim 30, further comprising applying a fluoropolymer composition.

55. The process of claim 30, further comprising applying a silane containing sealing composition is further on applied.

56. A non-chromate conversion coating produced by a process as claimed in claim 30.

57. The non-chromate conversion coating as claimed in claim 56, having a composition comprising at least one metal compound whereby the at least one metal is selected from the metals contained in the magnesium or magnesium alloy surface and further comprising fluor and aluminum and optionally silicon.

58. An article having at least on a part of its metallic surface a surface of magnesium or of any magnesium alloy which is coated with at least one coating which is formed by a process as claimed in claim 30, wherein the article is an aircraft, an aerospace vehicle, a missile, a motor vehicle, a train, an electronic device, an apparatus, construction, military equipment or sport equipment.

59. The process of claim 30, wherein said process solution further comprises a surfactant.

60. The process of claim 59, wherein said process solution further comprises aluminum ions or an aluminum-coating compound.

61. The process of claim 30, further comprising applying a further coating on said non-chromate conversion coating.

62. The process of claim 30, wherein the non-chromate conversion coating has a thickness of from 3 to 80 μm.

63. A process for forming a non-chromate conversion coating on surfaces of magnesium or magnesium alloys comprising the steps of:

providing clean surface of magnesium or a magnesium alloy;

contacting said surface with a process solution;

whereby said process solution is an aqueous solution or an aqueous dispersion having a pH in the range from 0.5 to 3 and comprising:

at least one fluorosilicon acid, at least one water-soluble pH adjustment agent, whereby the at least one water-soluble pH adjustment agent is at least one alkaline silicon compound selected from the group consisting of a silane, a silanol, a siloxane and a polysiloxane, which has at least one of an amino group, an ureido group or an imino group, and an aluminum source, wherein the non-chromate conversion coating is formed and wherein the non-chromate conversion coating is light gray to black.

64. The process of claim 63, wherein the non-chromate conversion coating has a thickness of from 3 to 80 μm.

65. A process for forming a non-chromate conversion coating on surfaces of magnesium or magnesium alloys comprising the steps of:

providing clean surface of magnesium or a magnesium alloy;

contacting said surface with a process solution;

whereby said process solution is an aqueous solution or an aqueous dispersion having a pH in the range from 0.5 to 3 and comprising:

at least one fluorosilicon acid in the range of from 4 to 100 g/L, at least one water-soluble pH adjustment agent, and at least one substance selected from the group consisting of a hydroxide, a compound containing an ammonium group, an amine, an amide, an imine, an amide, a silane, silanol, siloxane or polysiloxane having at least one amino group, an imino group or at least one ureido group, wherein the at least one water-soluble pH adjustment agent is at least one alkaline silicon compound selected from the group consisting of a silane, a silanol, a siloxane and a polysiloxane, which has at least one of an amino group, an ureido group or an imino group, wherein the non-chromate conversion and wherein the non-chromate conversion coating is light gray to black.

66. The process of claim 65, wherein the non-chromate conversion coating has a thickness of from 3 to 80 μm.

67. A process for forming non-chromate conversion coating on surfaces of magnesium or magnesium alloys comprising the steps of:

a) providing clean surfaces of magnesium or magnesium alloys, b) contacting said surfaces with a process solution, c) whereby said process solution is an aqueous solution or an aqueous dispersion heaving a pH in the range from 0.5 to 3 and comprising:

at least one fluorosilicon acid, optionally, at least one water-soluble pH adjustment agent, at least one surfactant: and optionally, aluminum as cations or as at least one compound or any combination thereof, d) wherein the non-chromate conversion coating is formed with the aid of the process solution and whereby optionally in a further step at least one further coating is applied; wherein the process solution further comprises a non-ionic surfactant has from 3 to 100 monomeric groups selected from ethylene oxide and propylene oxide monomeric groups with up to 15,000 carbon atoms, whereby the surfactant contains at least one long chain that may be a single chain, a double chain, a multiple of chains, a regular or irregular arrangement of ethylene oxide monomeric groups, propylene oxide monomeric groups, a blockcopolymer or any of their combinations, whereby the at least one chain is straight chain without or with bigger side groups and whereby the surfactant may optionally have an alkyl group with 6 to 24 carbon atoms and wherein the non-chromate conversion coating is light gray to black.

68. The process of claim 67, wherein the non-chromate conversion coating has a thickness of from 3 to 80 μm.

69. A process for forming a non-chromate conversion coating on surfaces of magnesium or magnesium alloys comprising the steps of:

a) providing clean surfaces of magnesium or magnesium alloys, b) contacting said surfaces with a process solution, c) whereby said process solution is an aqueous solution or an aqueous dispersion heaving a pH in the range from 0.5 to 3 and comprising:

at least one fluorosilicon acid, optionally, at least one water-soluble pH adjustment agent, at least one surfactant and optionally, aluminum as cations or as at least one compound or any combination of these, d) wherein the non-chromate conversion coating is formed with the aid of the process solution and whereby optionally in a step e) or in the steps e), f) and optionally any further step at least one further coating each may be applied, wherein the process solution contains at least one non-ionic surfactant which is selected from alkylpolyglucosides having a saturated or unsaturated alkyl group with an average number of carbon atoms in the range from 4 to 18 in each chain and having at least one chain which may be independent one from the other, which may be a linear or a branched chain and wherein the surfactant has an average number of 1 to 5 units of at least one glucoside, whereby the units of the at least one glucoside may be bound glucosidically to the alkyl group, and wherein the non-chromate conversion coating is light gray to black.

70. The process of claim 69, wherein the non-chromate conversion coating has a thickness of from 3 to 80 μm.

71. A process for forming a non-chromate conversion coating on surfaces of magnesium or magnesium alloys comprising the steps of:

providing clean surfaces of magnesium or magnesium alloys, contacting said surfaces with a process solution, wherein said process solution is an aqueous solution or an aqueous dispersion having a pH in the range from 0.5 to 3 and comprising:

at least one fluorosilicon acids;

a surfactant; and aluminum ions;

wherein a well visible coating is formed by the process solution;

wherein the surfactant is non-ionic and has 3 to 100 monomeric groups selected from ethylene oxide and propylene oxide monomeric groups with up to 15,000 carbon atoms, wherein the surfactant is a long chain that may be a single chain, a double chain, a multiple of chains, a regular or irregular arrangement of ethylene oxide monomeric groups, propylene oxide monomeric groups, a blockcopolymer a combination thereof, whereby the at least one chain may be a straight chain without or with bigger side groups, wherein the surfactant may optionally have an alkyl group with 6 to 24 carbon atoms and wherein the non-chromate conversion coating is light gray to black.

72. The process of claim 71, wherein the non-chromate conversion coating has a thickness of from 3 to 80 μm.

73. A process for forming a well visible non-chromate conversion coating on surfaces of magnesium or magnesium alloys comprising the steps of:

a) providing clean surfaces of magnesium or magnesium alloys, b) contacting said surfaces with a process solution, c) whereby said process solution is an aqueous solution or an aqueous dispersion having a pH in the range from 0.5 to 3 and comprising:

at least one fluorosilicon acid;

a surfactant; and aluminum ions;

the non-chromate conversion coating is formed with the aid of the process solution wherein the process solution contains at least one non-ionic surfactant which is selected from alkylpolyglucosides having a saturated or unsaturated alkyl group with an average number of carbon atoms in the range from 4 to 18 in each chain and having at least one chain which may be independent one from the other, which may be a linear or a branched chain and whereby the surfactant has an average number of 1 to 5 units of at least one glucoside, whereby the units of the at least one glucoside may be bound glucosidically to the alkyl group.

74. The process of claim 73, wherein the non-chromate conversion coating has a thickness of from 3 to 80 μm.

75. A process for forming a non-chromate conversion coating on surfaces of magnesium or magnesium alloys comprising the steps of:

providing clean surface of magnesium or a magnesium alloy;

contacting said surface with a process solution;

whereby said process solution is an aqueous solution or an aqueous dispersion having a pH in the range from 0.5 to 5 and comprising:

at least one fluorosilicon acid in the range of from 4 to 100 g/L, at least one water-soluble pH adjustment agent, whereby the at least one water-soluble pH adjustment agent is at least one alkaline silicon compound selected from the group consisting of a silane, a silanol, a siloxane and a polysiloxane, which has at least one of an amino group, an ureido group or an imino group, wherein the non-chromate conversion coating is formed with the aid of the process solution, wherein the process solution contains at least one non-ionic surfactant having 3 to 100 monomeric groups selected from ethylene oxide and propylene oxide monomeric groups with up to 15,000 carbon atoms, whereby the surfactant contains at least one long chain that may be a single chain, a double chain, a multiple of chains, a regular or irregular arrangement of ethylene oxide monomeric groups, propylene oxide monomeric groups, a blockcopolymer or any combination thereof, whereby the at least one chain may be a straight chain without or with bigger side groups and whereby the surfactant may optionally have an alkyl group with 6 to 24 carbon atoms.

76. A process for forming a non-chromate conversion coating on surfaces of magnesium or magnesium alloys comprising the steps of:

providing clean surface of magnesium or a magnesium alloy;

contacting said surface with a process solution;

whereby said process solution is an aqueous solution or an aqueous dispersion having a pH in the range from 0.5to 5 comprising:

at least one fluorosilicon acid in the range of from 4 to 100 g/L, at least one water-soluble pH adjustment agent, whereby the at least one water-soluble pH adjustment agent is at least one alkaline silicon compound selected from the group consisting of a silane, a silanol, a siloxane and a polysiloxane, which has at least one of an amino group, an ureido group or an imino group, whereby the non-chromate conversion coating is formed with the aid of the process solution, wherein the process solution contains at least one non-ionic surfactant selected from alkylpolyglucosides having C4-C18 unsaturated or saturated alkyl group and having at least one chain which is, independent one from the other, which may be a linear or a branched chain and whereby the surfactant has an average number of 1 to 5 units of at least one glucoside, whereby the units of the at least one glucoside are bound glucosidically to the alkyl group.

77. A process for forming a non-chromate conversion coating on surfaces of magnesium or magnesium alloys comprising the steps of:

a) providing clean surfaces of magnesium or magnesium alloys, b) contacting said surfaces with a process solution, c) whereby said process solution is an aqueous solution or an aqueous dispersion heaving a pH in the range from 0.5 to 5 and comprising:

at least one fluorosilicon acid, optionally, at least one water-soluble pH adjustment agent, at least one surfactant and optionally, aluminum as cations or as at least one compound or any combination thereof, d) wherein the non-chromate conversion coating is formed with the aid of the process solution and whereby optionally in a further step at least one further coating is applied; wherein the process solution further comprises a non-ionic surfactant has from 3 to 100 monomeric groups selected from ethylene oxide and propylene oxide monomeric groups with up to 15,000 carbon atoms, whereby the surfactant contains at least one long chain that may be a single chain, a double chain, a multiple of chains, a regular or irregular arrangement of ethylene oxide monomeric groups, propylene oxide monomeric groups, a blockcopolymer or any of their combinations, whereby the at least one chain is straight chain without or with bigger side groups and whereby the surfactant may optionally have an alkyl group with 6 to 24 carbon atoms.

78. A process for forming a non-chromate conversion coating on surfaces of magnesium or magnesium alloys comprising the steps of:

a) providing clean surfaces of magnesium or magnesium alloys, b) contacting said surfaces with a process solution, c) whereby said process solution is an aqueous solution or an aqueous dispersion heaving a pH in the range from 0.5 to 5 and comprising:

at least one fluorosilicon acid, optionally, at least one water-soluble pH adjustment agent, at least one surfactant and optionally, aluminum as cations or as at least one compound or any combination of these, d) wherein the non-chromate conversion coating is formed with the aid of the process solution and whereby optionally in a step e) or in the steps e), f) and optionally any further step at least one further coating each may be applied, wherein the process solution contains at least one non-ionic surfactant which is selected from alkylpolyglucosides having a saturated or unsaturated alkyl group with an average number of carbon atoms in the range from 4 to 18 in each chain and having at least one chain which may be independent one from the other, which may be a linear or a branched chain and wherein the surfactant has an average number of 1 to 5 units of at least one glucoside, whereby the units of the at least one glucoside may be bound glucosidically to the alkyl group.

79. A process for forming a non-chromate conversion coating on surfaces of magnesium or magnesium alloys comprising the steps of:

providing clean surfaces of magnesium or magnesium alloys, contacting said surfaces with a process solution, wherein said process solution is an aqueous solution or an aqueous dispersion having a pH in the range from 0.5 to 5 and comprising:

at least one fluorosilicon acid;

a surfactant; and aluminum ions;

wherein a well visible coating is formed by the process solution;

wherein the surfactant is non-ionic and has 3 to 100 monomeric groups selected from ethylene oxide and propylene oxide monomeric groups with up to 15,000 carbon atoms, wherein the surfactant is a long chain that may be a single chain, a double chain, a multiple of chains, a regular or irregular arrangement of ethylene oxide monomeric groups, propylene oxide monomeric groups, a blockcopolymer a combination thereof, whereby the at least one chain may be a straight chain without or with bigger side groups, wherein the surfactant may optionally have an alkyl group with 6 to 24 carbon atoms.

80. A process for forming a well visible non-chromate conversion coating on surfaces of magnesium or magnesium alloys comprising the steps of:

a) providing clean surfaces of magnesium or magnesium alloys, b) contacting said surfaces with a process solution, c) whereby said process solution is an aqueous solution or an aqueous dispersion having a pH in the range from 0.5 to 5 and comprising:

at least one fluorosilicon acid;

a surfactant; and aluminum ions;

wherein the non-chromate conversion coating is formed with the aid of the process solution wherein the process solution contains at least one non-ionic surfactant which is selected from alkylpolyglucosides having a saturated or unsaturated alkyl group with an average number of carbon atoms in the range from 4 to 18 in each chain and having at least one chain which may be independent one from the other, which may be a linear or a branched chain and whereby the surfactant has an average number of 1 to 5 units of at least one glucoside, whereby the units of the at least one glucoside may be bound glucosidically to the alkyl group.

* * * * *